US011274469B2

(12) United States Patent
Xu et al.

(10) Patent No.: US 11,274,469 B2
(45) Date of Patent: Mar. 15, 2022

(54) CONTROL METHOD AND CONTROL DEVICE FOR ELECTRONIC LOCK

(71) Applicant: Shandong New Beiyang Information Technology Co., Ltd., Shandong (CN)

(72) Inventors: Jiabo Xu, Shandong (CN); Pengxu Bao, Shandong (CN); Cong Liang, Shandong (CN); Chuntao Wang, Shandong (CN)

(73) Assignee: Shandong New Beiyang Information Technology Co., Ltd., Shandong (CN)

( * ) Notice: Subject to any disclaimer, the term of this patent is extended or adjusted under 35 U.S.C. 154(b) by 577 days.

(21) Appl. No.: 16/320,457

(22) PCT Filed: Jul. 27, 2017

(86) PCT No.: PCT/CN2017/094606

§ 371 (c)(1),
(2) Date: Jan. 24, 2019

(87) PCT Pub. No.: WO2018/024141

PCT Pub. Date: Feb. 8, 2018

(65) Prior Publication Data

US 2019/0264466 A1 Aug. 29, 2019

(30) Foreign Application Priority Data

Aug. 3, 2016 (CN) ..... 201610634119.3

(51) Int. Cl.
*E05B 47/00* (2006.01)
*E05B 65/52* (2006.01)

(52) U.S. Cl.
CPC ..... *E05B 47/0001* (2013.01); *E05B 47/00* (2013.01); *E05B 65/5253* (2013.01); *E05B 2047/0072* (2013.01)

(58) Field of Classification Search
CPC ..... E05B 47/0001; E05B 47/00; E05B 2047/0072; E05B 65/5253
See application file for complete search history.

(56) References Cited

U.S. PATENT DOCUMENTS 10,107,012 B2 * 10/2018 Kuriyama ..... E05B 81/72
11,035,156 B2 * 6/2021 Damboiu ..... E05B 81/16
(Continued)

FOREIGN PATENT DOCUMENTS

CN 102027179 A 4/2011
CN 104329882 A 2/2015
(Continued)

OTHER PUBLICATIONS

European Search Report dated Mar. 19, 2020, in the European application No. 17836323.0. 6 pages.
(Continued)

*Primary Examiner* — Mark A Williams
(74) *Attorney, Agent, or Firm* — Wilmer Cutler Pickering Hale and Dorr LLP

(57) ABSTRACT

A method and device for controlling an electronic lock are disclosed. The electronic lock includes a lock catch and a lock body that includes a first lock hook and a second lock hook. The first lock hook has a first lock hook locking position where it is engaged with the lock catch and a first lock hook unlocking position where it is separated from the lock catch. The second lock hook has a second lock hook locking position where it locks the first lock hook in the first lock hook locking position and a second lock hook unlocking position where it is separated from the first lock hook. The method includes: detecting whether a locking operation occurs; and when detecting a locking operation, controlling at least one of the first lock hook and the second lock hook to vibrate, allowing the second lock hook to lock the first
(Continued)

lock hook in the first lock hook locking position or to be separated from the first lock hook.

8 Claims, 7 Drawing Sheets

(56) References Cited

U.S. PATENT DOCUMENTS

| | | | | |
|---|---|---|---|---|
| 2002/0158727 | A1* | 10/2002 | Namen | E05B 47/026 335/78 |
| 2008/0238135 | A1* | 10/2008 | Takeda | G07C 9/00309 296/146.4 |
| 2011/0056253 | A1 | 3/2011 | Greiner et al. | |
| 2015/0354248 | A1* | 12/2015 | Promutico | D06F 37/42 292/138 |
| 2016/0047145 | A1* | 2/2016 | Johnson | E05B 47/0012 292/144 |
| 2016/0076277 | A1* | 3/2016 | Kouzuma | E05C 3/12 292/201 |
| 2018/0298640 | A1* | 10/2018 | Caterino | E05B 15/02 |
| 2020/0123808 | A1* | 4/2020 | Lovejoy | E05B 39/00 |

FOREIGN PATENT DOCUMENTS

| | | | |
|---|---|---|---|
| CN | 205224848 | U | 5/2016 |
| CN | 205400311 | U | 7/2016 |
| DE | 19754658 | C1 | 12/1998 |
| DE | 10116571 | A1 | 10/2002 |
| DE | 102008014976 | A1 | 11/2008 |
| WO | WO-2005/118989 | A1 | 12/2005 |

OTHER PUBLICATIONS

International Search Report dated Nov. 3, 2017, in the International Application No. PCT/CN2017/094606, 2 pages.

* cited by examiner

CONTROL METHOD AND CONTROL DEVICE FOR ELECTRONIC LOCK

CROSS-REFERENCE TO RELATED APPLICATIONS

This application is a U.S. national phase application of PCT Patent Application Publication Serial No. PCT/CN2017/094606, filed Jul. 27, 2017, and claims priority to and benefit of Chinese Patent Application No. 201610634119.3, filed Aug. 3, 2016 before the State Intellectual Property Office of P.R. China, which are incorporated herein by reference in their entireties.

TECHNICAL FIELD

The present disclosure relates to the electronic lock technology, and in particular to a method and a device for controlling an electronic lock.

BACKGROUND

The use of electronic locks in lockers is becoming increasingly widespread. For example, lockers used in the express delivery industry for temporary storage of express mails, and lockers for shopping malls and supermarkets for temporarily storing goods carried by shoppers are all provided with electronic locks. A control device of the locker controls the electronic lock to be unlocked or locked, so as to control the opening and closing of the door of the box.

The related art discloses an electronic lock, as shown in FIGS. 1A and 1B, the electronic lock includes a lock catch 310' and a lock body 320'. The lock catch 310' is mounted on the door of the locker, and the lock body 320' is mounted on the body of the locker. The lock body 320' includes a first lock hook 1', a second lock hook 2', a first elastic member 3' and a second elastic member 4'. The first lock hook 1' has a first position (as shown in FIG. 1A) that is locked with the lock catch 310' and a second position (as shown in FIG. 1B) that is separated from the lock catch 310'. The second lock hook 2' has a third position configured to lock the lock hook 1' in the first position and a fourth position configured to be separated from the first lock hook 1'. The first elastic member 3' is connected to the first lock hook 1'. Under the elastic force of the first elastic member 3', the first lock hook 1' has a tendency to rotate toward the second position. The second elastic member 4' is connected to the second lock hook 2', and under the elastic force of the second elastic member 4', the second lock hook 2' has a tendency to rotate toward the third position. When the user performs a locking operation, the lock catch 310 moves in the direction indicated by the arrow in FIG. 1B, driving the first lock hook 1' to move from the second position to the first position. During the movement, a locking portion 11' of the first lock hook 1' is engaged with a slot 21' of the second lock hook 2', and the second lock hook 2' locks the first lock hook 1' in the first position under the elastic force of the second elastic member 4'.

In an electronic lock of the related art, when the user performs the locking operation, a clamping cooperation between the second lock hook 2' and the first lock hook 1' are completed by pushing the door against the elastic force of the first elastic member 3' and the second elastic member 4'. If the user applies an improper force, the locking portion 11' of the first lock hook 1' and the slot 21' of the second lock hook 2' are prone to a critical state like a snap-up unbonded state, which is usually called a pseudo lock state of the electronic lock. When the electronic lock is located in the pseudo lock state, the door seems to have been closed, but it is actually not closed tight. At this time, the items stored in the locker are vulnerable to security risks, and therefore, the electronic lock of the related art has the problem of poor safety performance.

In view of the poor safety performance of the electronic lock of the related art, no effective solution has been proposed yet.

SUMMARY

In view of this, the present disclosure provides a method and a device for controlling an electronic lock that solves the problem of poor security performance of electronic lock in the related art.

According to a first aspect, an embodiment of the present disclosure provides a method for controlling an electronic lock. The electronic lock includes a lock catch and a lock body, the lock body comprises a first lock hook and a second lock hook. The first lock hook has a first lock hook locking position where the first lock hook is engaged with the lock catch and a first lock hook unlocking position where the first lock hook is separated from the lock catch. The second lock hook has a second lock hook locking position where the second lock hook is operative to lock the first lock hook in the first lock hook locking position and a second lock hook unlocking position where the second lock hook is separated from the first lock hook. The method includes the following operations: Detecting whether a locking operation occurs, wherein the locking operation is an operation in which the first lock hook is moved away from the first lock hook unlocking position; Controlling at least one of the first lock hook and the second lock hook to vibrate when the locking operation is detected, so that the second lock hook locks the first lock hook in the first lock hook locking position or is separated from the first lock hook.

In one or more embodiments, the operation of controlling at least one of the first lock hook and the second lock hook to vibrate includes controlling the second lock hook to vibrate.

In one or more embodiments, the lock body includes a housing, the second lock hook is pivotally connected to the housing via a pivoting shaft, and the second lock hook is operative to rotate about the pivoting shaft to the second lock hook locking position or the second lock hook unlocking position. The step of controlling the second lock hook to vibrate includes driving the second lock hook to rotate back and forth a preset number of times with a rotation angle of a first angle, wherein the preset number of times is greater than or equal to one time, the first angle is smaller than a second angle, which is a rotation angle across which the second lock hook rotates from the second lock hook locking position to the second lock hook unlocking position.

In one or more embodiments, the electronic lock further includes a vibrator, the vibrator is disposed within the lock body, and when the vibrator vibrates, the vibrator is operative to drive at least one of the first lock hook and the second lock hook to vibrate. The step of controlling at least one of the first lock hook and the second lock hook to vibrate includes controlling the vibrator to vibrate to drive at least one of the first lock hook and the second lock hook to vibrate.

In one or more embodiments, after the operation of controlling at least one of the first lock hook and the second lock hook to vibrate, the method further includes detecting whether the first lock hook is located in the first lock hook unlocking position, and outputting a prompt message to remind a user to re-perform the locking operation when detecting that the first lock hook is located in the first lock hook unlocking position.

According to a second aspect, an embodiment of the present disclosure provides a device for controlling an electronic lock. The electronic lock includes a lock catch and a lock body, the lock body comprises a first lock hook and a second lock hook. The first lock hook has a first lock hook locking position where the first lock hook is engaged with the lock catch and a first lock hook unlocking position where the first lock hook is separated from the lock catch. The second lock hook has a second lock hook locking position where the second lock hook is operative to lock the first lock hook in the first lock hook locking position and a second lock hook unlocking position where the second lock hook is separated from the first lock hook. The control device includes a first detection module and a vibration module. The first detection module is configured to detect whether a locking operation occurs, wherein the locking operation is an operation in which the first lock hook is moved away from the first lock hook unlocking position. The vibration module is configured to control at least one of the first lock hook and the second lock hook to vibrate when the locking operation is detected, so that the second lock hook locks the first lock hook in the first lock hook locking position or is separated from the first lock hook.

In one or more embodiments, the vibration module includes a second lock hook vibration unit configured to control the second lock hook to vibrate.

In one or more embodiments, the lock body includes a housing, the second lock hook is pivotally connected to the housing via a pivoting shaft, and the second lock hook is operative to rotate about the pivoting shaft to the second lock hook locking position or the second lock hook unlocking position. The second lock hook vibration unit includes a vibration sub-unit. The vibration sub-unit is configured to drive the second lock hook to rotate back and forth a preset number of times with a rotation angle of a first angle. The preset number of times is greater than or equal to one time, the first angle is smaller than a second angle, the second angle being a rotation angle at which the second lock hook rotates from the second lock hook locking position to the second lock hook unlocking position.

In one or more embodiments, there is further disposed a vibrator within the lock body, and when the vibrator vibrates, the vibrator is operative to drive at least one of the first lock hook and the second lock hook to vibrate. The vibration module includes a vibrator vibration unit configured to control the vibrator to vibrate to drive at least one of the first lock hook and the second lock hook to vibrate.

In one or more embodiments, the control device further includes a second detection module and an information output module. The second detection module is configured to detect whether the first lock hook is located in the first lock hook unlocking position, after the operation of the vibration module controlling at least one of the first lock hook and the second lock hook to vibrate. The information output module is configured to output a prompt message to remind a user to re-perform the locking operation when detecting that the first lock hook is located in the first lock hook unlocking position.

According to a third aspect, an embodiment of the present disclosure provides a computer readable storage medium storing computer executable instructions, the computer executable instructions being configured to perform the method according to any one of the methods described above.

In the method and device for controlling an electronic lock in accordance with the embodiments of the present disclosure, when the locking operation is detected, at least one of the first lock hook and the second lock hook is controlled to vibrate. Since the electronic lock is easily changed in a pseudo lock state due to other external force, the method and device for controlling an electronic lock according to the embodiments of the present disclosure control at least one of the first lock hook and the second lock hook to vibrate, capable of changing the pseudo lock state of the electronic lock, so that the second lock hook locks the first lock hook in the first lock hook locking position or the second lock hook is separated from the first lock hook, and the electronic lock is accordingly locked or unlocked. When the electronic lock is locked, the door in which the electronic lock is installed will be locked. When the electronic lock is unlocked, the door in which the electronic lock is installed will be opened, and the user can observe the opening of the door and will re-execute the locking operation, so that the door is locked.

Therefore, the method and the device for controlling an electronic lock according to the embodiment can improve the safety of the user's stored items and effectively solve the problem of poor performance of electronic locker in the related art.

REFERENCE MARKS

In Related Art

Figure 1A:
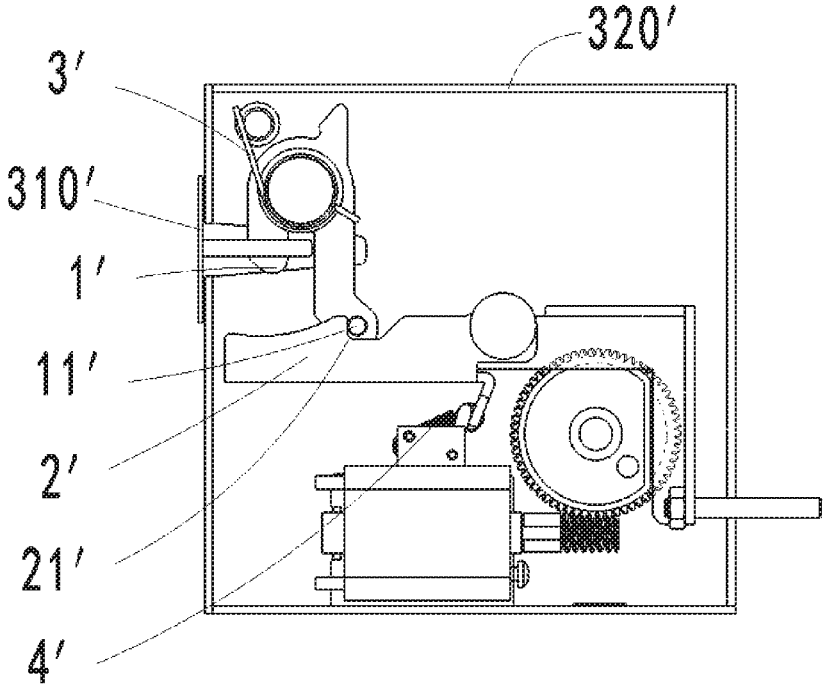
FIG. 1A is a schematic diagram of an electronic lock in locked state according to the related art.
Figure 1B:
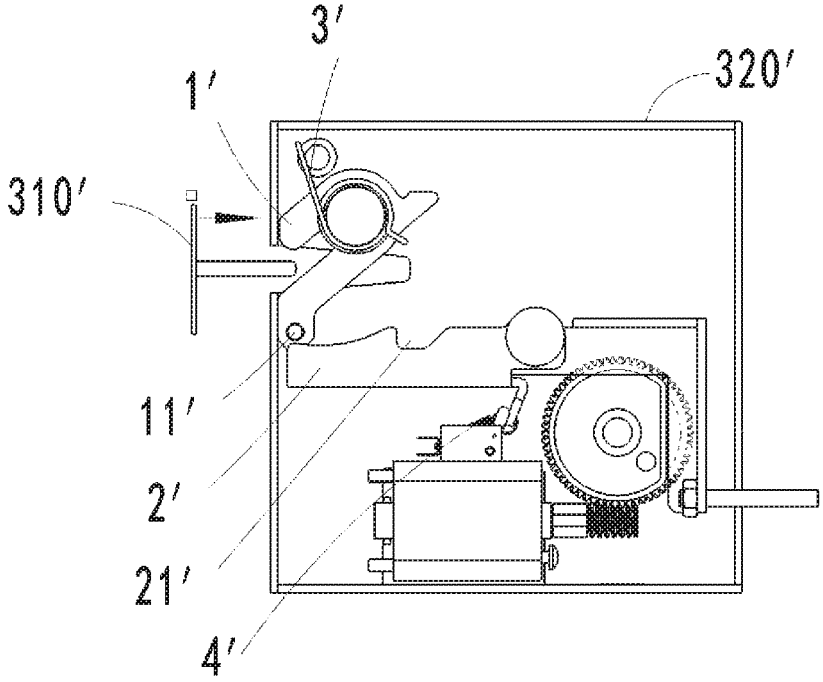
FIG. 1B is a schematic diagram of an electronic lock in unlocked state according to the related art.

310'—Lock Catch, 320'—Lock Body, 1'—First Lock Hook, 2'—Second Lock Hook, 3'—First Elastic Member, 4'—Second Elastic Member, 11'—Locking Portion, 21'—Slot.

In This Embodiment

100—Box, 200—Door, 300—Electronic Lock;

310—Lock Catch, 320—Lock Body;

1—First Lock Hook, 11—First Pivoting Shaft, 12—First Slot, 13—Locking Portion, 14—First Elastic Member;

2—Second Lock Hook, 21—Second Pivoting Shaft, 22—Second Slot, 23—Second Elastic Member;

4—Housing, 41—First Housing, 42—Second Housing, 43—Opening;

51—Motor, 52—Worm, 53—Turbine, 54—Driving Cylinder;

6—Sensor, 7—Vibrator.

DETAILED DESCRIPTION

The technical solutions reflected by the embodiments in accordance with the present disclosure will be described clearly and completely in connection with the drawings in the embodiments of the present disclosure. These embodiments however are merely a part rather than all of the embodiments in accordance with the present disclosure. The various components in the embodiments of the present disclosure, which are generally described and illustrated in the drawings herein, may be arranged and designed in various different configurations. The specific embodiments described herein are merely intended to explain the present disclosure rather than limiting the scope of the present disclosure, which is set forth in the claims, but merely to represent some possible embodiments of the present disclosure.

Since the electronic lock is usually disposed in the locker as a component of the locker, the following describes the specific structure of the electronic lock, the specific structure of the locker, and the specific functions of the locker according to the embodiments of the present disclosure to introduce the method and device for controlling an electronic lock provided by the embodiments of the present disclosure.

Figure 2:
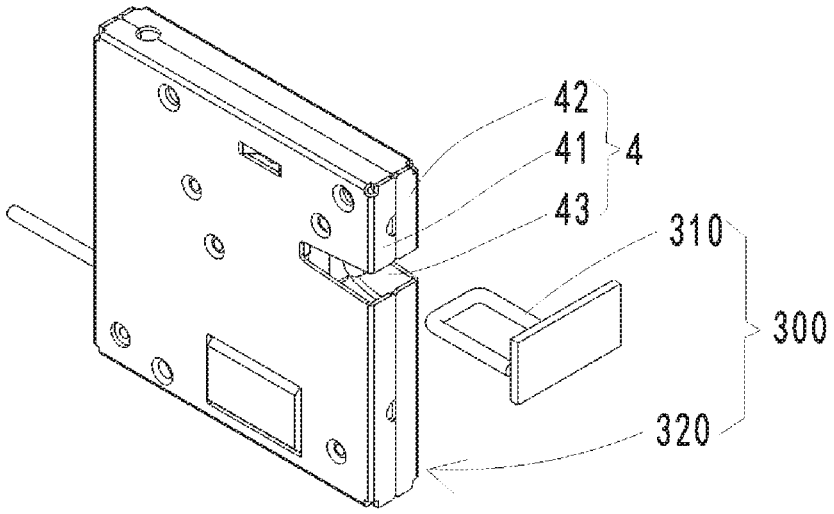
FIG. 2 is a schematic diagram of an electronic lock according to an embodiment of the present disclosure.

FIG. 2 is a schematic diagram illustrating an electronic lock according to an embodiment of the present disclosure. As shown in FIG. 2, the electronic lock 300 includes a lock catch 310 and a lock body 320. The lock body 320 may be engaged with or separated from the lock catch 310. When the lock catch 310 and the lock body 320 are engaged, the electronic lock is in a locked state, and when the lock catch 310 and the lock body 320 are separated, the electronic lock is in an unlocked state.

Figure 3:
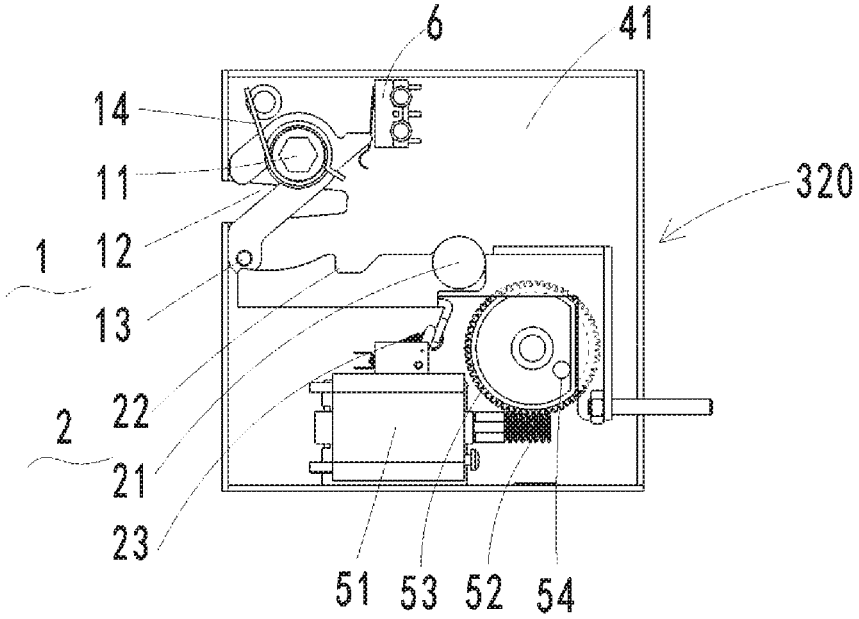
FIG. 3 is a first schematic diagram illustrating internal structure of a lock body of an electronic lock according to an embodiment of the present disclosure.
Figure 4:
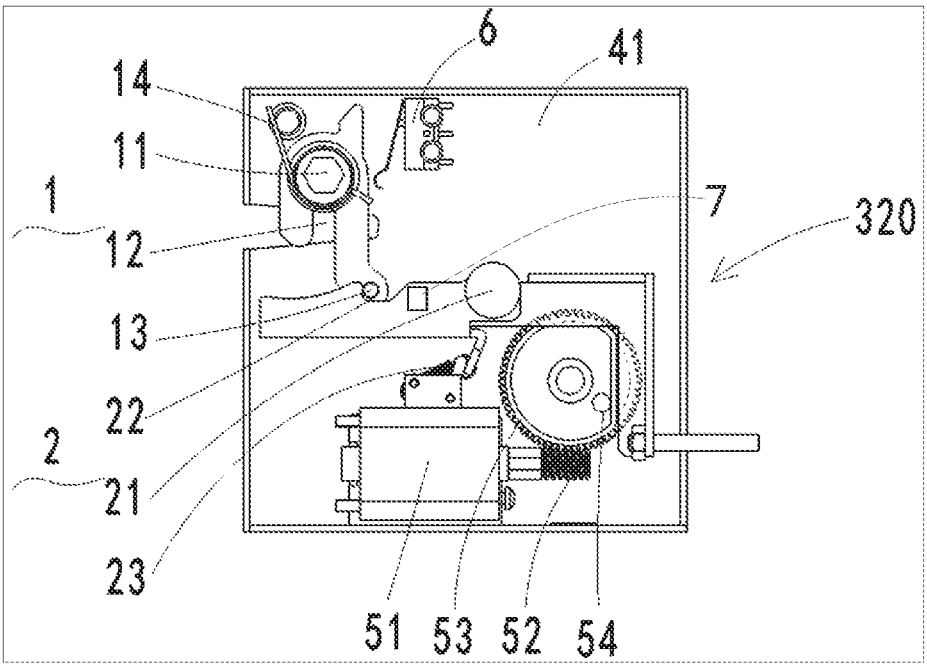
FIG. 4 is a second schematic diagram illustrating internal structure of a lock body of an electronic lock according to an embodiment of the present disclosure.

FIG. 3 and FIG. 4 are schematic diagrams illustrating the internal structure of a lock body of an electronic lock according to an embodiment of the present disclosure. As illustrated in FIGS. 2, 3 and 4, the lock body 320 includes a first lock hook 1 and a second lock hook 2. The first lock hook 1 has a first lock hook locking position where the first lock hook is engaged with the lock catch 310 of the electronic lock and a first lock hook unlocking position where the first lock hook is separated from the lock catch 310. The second lock hook 2 is selectively connected to the first lock hook 1, and the second lock hook 2 has a second lock hook locking position where the second lock hook is operative to lock the first lock hook 1 in the first lock hook locking position and a second lock hook unlocking position where the second lock hook is separated from the first lock hook 1.

The lock body 320 further includes a housing 4 which includes a first housing 41 and a second housing 42. The first housing 41 and the second housing 42 are butted up against each other to form a closed box, the first lock hook 1 and the second lock hook 2 are mounted in the closed box, and an opening 43 is provided in the housing 4.

The first lock hook 1 is pivotally connected to the housing 4 through the first pivoting shaft 11 and is rotatable about an axis of the first pivoting shaft 11, so as to be located at the first lock hook locking position or the first lock hook unlocking position. The first lock hook 1 includes a first slot 12 configured to be engaged with the lock latch 310. The first slot 12 is a slot having an opening. As illustrated in FIG. 3, when the first lock hook 1 is located in the first lock hook unlocking position, the first slot 12 opens the opening 43 of the housing 4, and the lock latch 310 may enter or exit the lock body 320 through the opening 43. As shown in FIG. 4, when the first lock hook 1 is located in the first lock hook locking position, the first slot 12 closes the opening 43. At this time, if the first slot 12 is engaged with the lock latch 310, the lock latch 310 cannot be withdrawn from the lock body 320 through the opening 43. The first lock hook 1 further includes a locking portion 13 which has a shape of a shaft or a rod, or other structures. In the present embodiment, the locking portion 13 is a shaft-shaped structure.

The second lock hook 2 is pivotally connected to the housing 4 via the second pivoting shaft 21 and is rotatable about an axis of the second pivoting shaft 21. The second lock hook 2 includes a second slot 22 configured to be engaged with the locking portion 13 of the first lock hook 1. When the second lock hook 2 rotates about the axis of the second pivoting shaft 21, the second locking slot 22 is capable of engaging with or separating from the locking portion 13. As illustrated in in FIG. 4, when the second slot 22 is engaged with the locking portion 13, the second lock hook 2 is located in the second lock hook locking position, and the first lock hook 1 is locked in the first lock hook locking position, so that the first lock hook 1 cannot rotate around the axis of the first pivoting shaft 11. When the second slot 22 is separated from the locking portion 13, the second lock hook 2 is located in the second lock hook unlocking position, and the first lock hook 1 can rotate around the axis of the first pivoting shaft 11.

The lock body 320 further includes an elastic reset assembly disposed inside the housing 4, and the elastic reset assembly includes a first elastic member 14 and a second elastic member 23. The first lock hook 1 is connected with the housing 4 through the first elastic member 14, and under an elastic force of the first elastic member 14, the first lock hook 1 would always have a tendency to rotate toward the first lock hook unlocking position. The second lock hook 2 is connected to the housing 4 through the second elastic member 23, and under an elastic force of the second elastic member 23, the second lock hook 2 always has a tendency to rotate toward the second lock hook locking position.

When no other external forces are present, the second lock hook 2 would always be located in the second lock hook locking position under the action of the second elastic member 23. When the user performs a locking operation, the user pushes the lock latch 310 to drive the first lock hook 1 to move from the first lock hook unlocking position to the first lock hook locking position. During the movement of the first lock hook 1, the locking portion 13 contacts the second lock hook 2 and drives the second lock hook 2 to rotate from the second lock hook locking position to the second lock hook unlocking position. As illustrated in FIG. 3, the second lock hook unlocking position is a position where the second lock hook 2 reaches when it rotates counterclockwise around its rotating center at a certain angle from the second lock hook locking position. When the locking portion 13 and the second lock hook 2 are opposite to each other, the second lock hook 2 rotates under the elastic force of the second elastic member 23 from the second lock hook unlocking position to the second lock hook locking position. The second slot 22 of the lock hook 2 is engaged with the locking portion 13 of the first lock hook 1 to lock the first lock hook 1 in the first lock hook locking position, the electronic lock is locked, and the second lock hook 2 is located in the second lock hook locking position.

When the user performs an unlocking operation, the second lock hook 2 rotates counterclockwise from the second lock hook locking position to the second lock hook unlocking position. The locking force between the second lock hook 2 and the first lock hook 1 disappears, so that the first lock hook 1 is separated from the second lock hook 2, and the first lock hook 1 rotates under the elastic force of the first elastic member 14 to the first lock hook unlocking position. The opening 43 is opened, and when the first lock hook 1 moves towards the first lock hook unlocking position, the first lock hook drives the lock latch 310 to withdraw from the lock body 320 via the opening 43, thereby completing the unlocking process. When the first lock hook 1 rotates to the first lock hook unlocking position, the second lock hook 2 is separated from the first lock hook 1, and the second lock hook 2 rotates clockwise from the second lock hook unlocking position to the second lock hook locking position under the elastic force of the second elastic member 23.

The lock body 320 further includes a driving assembly 5, which is configured to drive the second lock hook 2 to rotate toward the second lock hook unlocking position. In this embodiment, the driving assembly 5 includes a motor 51, a worm 52, a turbine 53, and a driving cylinder 54. The motor 51 is fixed on the housing 4. The worm 52 is fixedly connected with the output shaft of the motor 51. The turbine 53 and the worm 52 form a meshing connection. The turbine 53 is pivotally connected to the housing 4. The driving cylinder 54 is vertically disposed on an end surface of the turbine 53, and is spaced apart from a center of rotation of the turbine 53. When the output shaft of the motor 51 rotates, the worm 52 and the turbine 53 are driven. The driving cylinder 54 rotates with the turbine 53 about the center of rotation of the turbine 53. When the driving cylinder 54 rotates, the driving cylinder 54 can be engaged or disengaged from the second lock hook 2. When the driving cylinder 54 abuts against the second lock hook 2, the driving cylinder 54 drives the second lock hook 2 to rotate from the second lock hook locking position to the second lock hook unlocking position by overcoming the elastic force of the second elastic member 23. When the driving cylinder 54 is driven separated from the second lock hook 2, the second lock hook 2 returns to the second lock hook locking position under the elastic force of the second elastic member 23. When the motor 51 is stopped, the driving cylinder 54 is located in an initial position separated from the second lock hook 2.

In the electronic lock in accordance with other embodiments provided by the present disclosure, the driving assembly 5 includes an electromagnet, where a driving shaft of the electromagnet is connected to the second lock hook 2. When the electromagnet is energized, the driving shaft of the electromagnet drives the second lock hook 2 to rotate the set angle about the axis of the second pivoting shaft 21 toward the second lock hook unlocking position, and the second lock hook 2 reaches the second lock hook unlocking position. When the electromagnet is de-energized, the second lock hook 2 rotates to the second lock hook locking position under an action of the second elastic member 23.

The lock body 320 further includes a sensor 6 that is capable of being engaged with or separated from the first lock hook 1 for detecting whether the first lock hook 1 is located in the first lock hook unlocking position. As illustrated in FIG. 3, when the first lock hook 1 is located in the first lock hook unlocking position, the first lock hook 1 engages with the sensor 6 and the sensor 6 outputs a first detecting signal, such as a high level voltage. As illustrated in FIG. 4, when the first lock hook 1 is separated from the first lock hook unlocking position, the sensor 6 is separated from the first lock hook 1 and the sensor 6 outputs a second detecting signal, such as a low level voltage.

Figure 6:
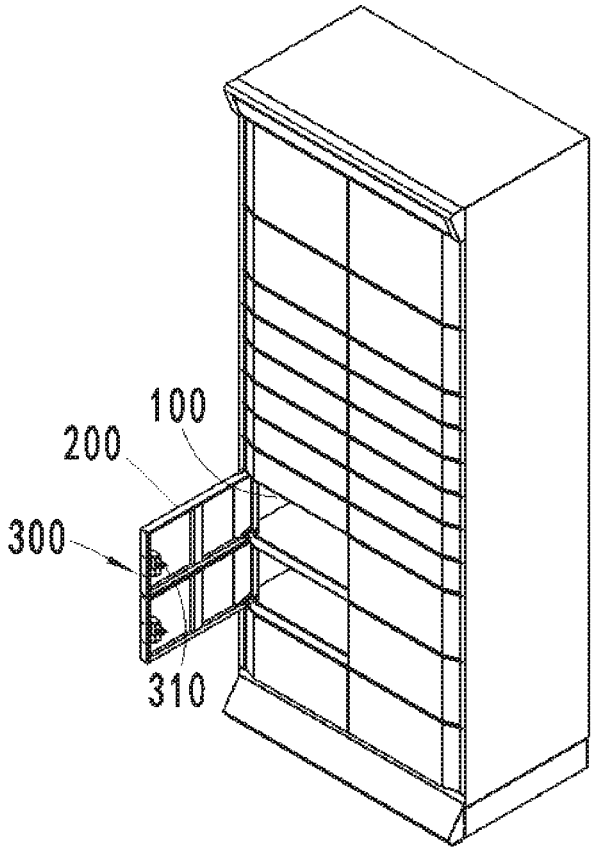
FIG. 6 is a structure diagram of a locker according to an embodiment of the present disclosure.

FIG. 6 is a structure diagram of a locker according to an embodiment of the present disclosure. As illustrated in FIG. 6, the locker includes a plurality of storage boxes, each storage box including a box 100, a door 200, and an electronic lock 300. The box 100 is a rectangular parallelepiped structure with a single-sided opening. The door 200 and the box 100 are pivotally connected through a pivoting shaft. The door 200 may rotate around an axis of the pivoting shaft to close or open the box 100. When the door 200 opens the box 100, the user can put items in the box 100 or take out the items from the box 100. When the door 200 closes the box 100, the items in the box 100 cannot be taken out.

The electronic lock 300 is disposed between the box 100 and the door 200 and is configured to lock the door 200 onto the box 100, so that the door 200 closes the box 100. A lock catch 310 of the electronic lock 300 is disposed on the door 200, and a lock body 320 is disposed on the box 100. When the door 200 closes the box 100, the first slot 12 of the first lock hook 1 of the lock body 320 is engaged with the lock catch 310 to lock the position of the door 200. The structure and working principle of the electronic lock 300 are as described in the above embodiments of FIGS. 2 to 4, and so details are not to be described herein again.

Figure 7A:
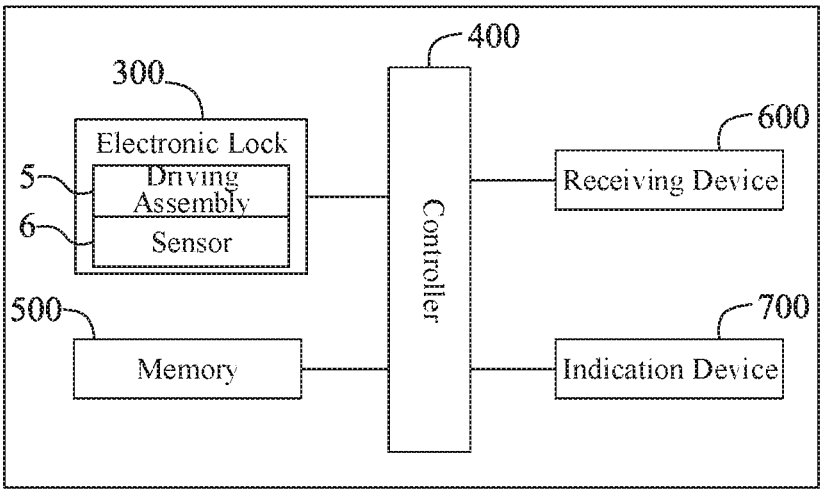
FIG. 7A is a block diagram illustrating the composition of a locker according to an embodiment of the present disclosure.

FIG. 7A is a block diagram illustrating the composition of a locker according to an embodiment of the present disclosure. As shown in FIG. 7A, the locker further includes a controller 400, a memory 500, a receiving device 600, and an indication device 700.

A controller 400 is configured to control the work of other modules and to perform operations and processing of data. For example, the controller 400 sends a vibrating control signal to the driving assembly 5 of the electronic lock 300 to control the driving assembly 5 to drive the second lock hook 2 to rotate about the axis of the second pivoting shaft 21. The controller 400 receives a detecting signal output by the sensor 6 of the electronic lock 300 and determines whether the first lock hook 1 is located in the first lock hook unlocking position according to detecting signal. For example, when receiving a first detecting signal output by the sensor 6, the controller 400 determines that the first lock hook 1 is located in the first lock hook unlocking position. When receiving a second detecting signal output by the sensor 6, the controller 400 determines that the first lock hook 1 is separated from the first lock hook unlocking position.

The memory 500 is configured to store the control program of the locker and controlling data and variables required during the running of the program, and the memory 500 may be a non-volatile memory. For example, when the driving assembly 5 includes the motor 51, the memory 500 is configured to store a first preset angle and a second preset angle, and the first preset angle and the second preset angle are rotation angles of an output shaft of the motor 51 when the second lock hook is controlled to vibrate. When the driving assembly 5 includes the electromagnet, the memory 500 is configured to store a first preset time, a second preset time, and a third preset time. The first preset time is an energizing time of the electromagnet each time the second lock hook is vibrated, and the second preset time is the power-off time of the electromagnet each time the second lock hook is vibrated, and the third preset time is an energizing time of the electromagnet during the unlocking operation. The memory is further configured to store a preset number of times, where the preset number of times is a number of times the second lock hook rotates back and forth when the second lock hook is vibrated.

When the driving assembly 5 includes the electromagnet, the electromagnet performs the unlocking operation by energizing the third preset time: the electromagnet is energized for the third preset time, and the driving shaft of the electromagnet drives the second lock hook 2 to rotate counterclockwise around the axis of the second pivoting shaft 21 to the second lock hook unlocking position during the energization of the electromagnet, an engaging force between the second lock hook 2 and the first lock hook 1 disappears, and the first lock hook 1 rotates to the first lock hook unlocking position under the elastic force of the first elastic member 14, the opening 43 is opened, and when the first lock hook 1 moves towards the first lock hook unlocking position, the first lock hook drives the lock latch 310 to withdraw from the lock body 320 via the opening 43, thereby completing the unlocking operation. When the electromagnet is de-energized, the second lock hook 2 rotates clockwise from the second lock hook unlocking position to the second lock hook locking position under the elastic force of the second elastic member 23.

A receiving device 600 is configured to receive an unlocking command input by the user, and the receiving device 600 may be a communication unit, a Radio Frequency Identification (RFID) data reading unit, a barcode scanning unit, a mechanical button, or a touching button, or the like. When the receiving device 600 is the communication unit, the receiving device 600 receives an unlocking command sent by the user through the host (such as a computer or network device connected to the locker). When the receiving device 600 is an RFID data reading unit, the receiving device 600 receives the unlocking command by reading the RFID data. When the receiving device 600 is a barcode scanning unit, the receiving device 600 receives the unlocking command by reading the barcode data. When the receiving device 600 is a mechanical button or a touch button, the receiving device 600 receives the unlocking command by receiving a user's pressing or tapping operation.

An indication device 700 is configured to send a prompt message to the user by means of light or sound according to the requirements of the controller 400. The indication device 700 may be an indicator light, a liquid crystal display, a buzzer, a voice device, or the like. When the indication device 700 is an indicator light, the prompt message is sent to the user by flashing at a set frequency. When the indication device 700 is a liquid crystal display, the prompt message is sent to the user by displaying a corresponding text message. When the indication device 700 is a buzzer, the prompt message is sending to the user by buzzing at a set frequency. When the indication device 700 is a voice device, the prompt message is send to the user by issuing a corresponding voice message.

Figure 8:
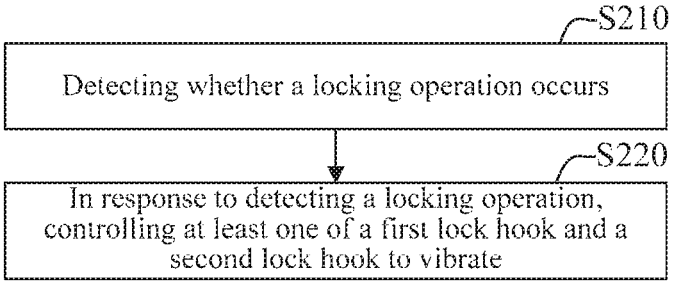
FIG. 8 is a flowchart of a method for controlling an electronic lock according to an embodiment of the present disclosure.

FIG. 8 is a flowchart illustrating a method for controlling an electronic lock according to an embodiment of the present disclosure, and the method can be performed by the controller 400 in FIG. 7A. The controller 400 controls the electronic lock of the locker in the following manner. As illustrated in the drawings, the method includes the following steps S210-S220.

In step S210, the method includes detecting whether a locking operation occurs.

In detecting whether a locking operation occurs, the locking operation refers to an operation in which the first lock hook leaves the first lock hook unlocking position. That is, the first lock hook changes its position from the first lock hook unlocking position to a position that is detached from the first lock hook unlocking position. In this embodiment, a detection is performed regarding whether the locking operation occurs based on the detecting signal output by the sensor. Taking the locker of the embodiment as an example, the locking operation is the operation of the user closing the door. The controller 400 detects the detecting signal output by the sensor 6 of the electronic lock 300, and determines whether the user has performed the locking operation according to the detecting signal output by the sensor 6. For example, when detecting that a signal output by the sensor 6 is changed from the first detecting signal to the second detecting signal, it is determined that the position of the first lock hook 1 of the electronic lock 300 is changing from being located in the first lock hook unlocking position to being separated from the first lock hook unlocking position; that is, it is determined that the user have performed a locking operation. The method then proceeds to step S220.

In step S220, when it is detected that the locking operation has occurred, at least one of the first lock hook and the second lock hook is controlled to vibrate, so that the second lock hook locks the first lock hook in the first lock hook locking position or the second lock hook is separated from the first lock hook.

When the first lock hook and the second lock hook are in a pseudo lock state by the locking operation in step S210, if the electronic lock is vibrated by an external force, the pseudo lock state will be changed. Basing on this, at least one of the first lock hook and the second lock hook is controlled to vibrate when the locking operation is detected, so that the second lock hook locks the first lock hook in the first lock hook locking position or the second lock hook is separated from the first lock hook, thereby changing the pseudo lock state of the electronic lock, improving the safety performance of the electronic lock.

In view of the fact that the electronic lock is internally provided with a driving assembly configured to drive the second lock hook, controlling at least one of the first lock hook and the second lock hook to vibrate may control the second lock hook to vibrate. The process of controlling the second lock hook to vibrate includes following: Driving the second lock hook to rotate back and forth a preset number of times with a first angle as a rotation angle, where the preset number of times is greater than or equal to one time.

The first angle is smaller than the second angle, and the second angle is a rotation angle at which the second lock hook rotates from the second lock hook locking position to the second lock hook unlocking position.

Taking the locker of the embodiment as an example, when the locking operation is detected, the controller 400 sends a vibrating control signal to the driving assembly 5 of the electronic lock 300, so that the driving assembly 5 drives the second lock hook 2 to rotate with a first angle back and forth for a preset number of times, where the preset number of times is greater than or equal to one time, the first angle is smaller than the second angle, and the second angle is a rotation angle at which the second lock hook rotates from the second lock hook locking position to the second lock hook unlocking position. In one or more embodiments, the first angle is less than one third of the second angle and the first angle is greater than one tenth of the second angle.

For example, in the embodiment illustrated in FIG. 3 and FIG. 4 of the present disclosure, the driving assembly 5 of the electronic lock 300 includes the motor 51, and the vibrating control signal is a control signal for controlling the output shaft of the motor 51 to rotate the first preset angle in different directions. During the rotation of the output shaft of the motor 51, the second lock hook 2 rotates back and forth with the first angle, thereby realizing the vibration of the second locking hook 2.

In one embodiment, the controller 400 sends a vibrating control signal to the motor 51. After the motor 51 receives the vibrating control signal, firstly, the output shaft of the motor 51 rotates toward the first direction with a first preset angle, and the output shaft of the motor 51 rotates and drives the turbine 53 to drive the driving cylinder 54 to rotate counterclockwise from the initial position. During the rotation of the driving cylinder 54, the driving cylinder 54 abuts against the second lock hook 2 and moves toward the second lock hook 2, thereby driving the second lock hook 2 to rotate counterclockwise about the axis of the second pivoting shaft 21.

When the rotation angle of the output shaft of the motor 51 reaches the first preset angle, the rotation angle of the second lock hook 2 reaches the first angle, and then the output shaft of the motor 51 rotates along a second direction with the first preset angle. The output shaft of the motor 51 rotates and drives the turbine 53 to drive the driving cylinder 54 to rotate clockwise, and the driving cylinder 54 moves away from the second lock hook 2 during the rotation of the driving cylinder 54. A driving force of the driving cylinder 54 on the second lock hook 2 disappears, and the second lock hook 2 rotates clockwise around the axis of the second pivoting shaft 21 under the elastic force of the second elastic member 23. When the rotation angle of the output shaft of the motor 51 reaches the first preset angle, the driving cylinder 54 returns to the initial position, and the rotation angle of the second lock hook 2 reaches the first angle. The controller 400 sends the vibrating control signal to the motor 51 for a preset number of times, so that the second lock hook 2 rotates back and forth with the first angle as a rotation angle by the preset number of times.

Figure 5A:
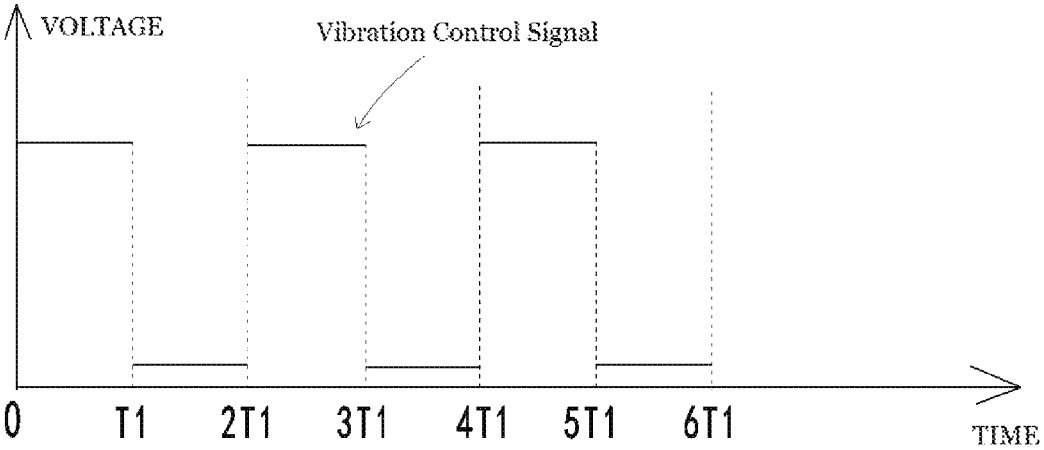
FIG. 5A is a schematic diagram of a control signal received by the motor when the second lock hook vibrates according to an embodiment of the present disclosure.

FIG. 5A is a schematic diagram illustrating a control signal received by the motor when the second lock hook vibrates according to an embodiment of the present disclosure. The control signal includes a vibrating control signal, and when the control signal received by the motor 51 is at a high level, the output of the motor 51 rotates along the first direction. When the control signal received by the motor 51 is a low level, the output shaft of the motor 51 rotates along the second direction. As illustrated in FIG. 5A, the motor 51 receives a high level for a duration T1, during which the output shaft of the motor 51 rotates the first preset angle along the first direction. During the process, the column 54 drives the second lock hook 2 to rotate counterclockwise about the axis of the second pivoting shaft 21 with the first angle. And then the motor 51 receives a low level for duration T1, and the output shaft of the motor 51 rotates with the first preset angle along the second direction. During the process, the second lock hook 2 rotates clockwise about the axis of the second pivoting shaft 21 under the elastic force of the second elastic member 23 with the first angle. The motor 51 receives the vibrating control signal for three cycles. Therefore, the motor 51 drives the second lock hook 2 to rotate back and forth three times with the first angle.

In another embodiment, the controller 400 sends a first control signal, the vibrating control signal, and a second control signal to the motor 51. Firstly, the controller 400 sends the first control signal to the motor 51, and after the motor 51 receives the first control signal, the output shaft of the motor 51 rotates along the second direction with the second preset angle. The output shaft of the motor 51 rotates and drives the turbine 53 to drive the driving cylinder 54 to rotate clockwise from the initial position. When the angle of the output shaft of the motor 51 reaches the second preset angle, the driving cylinder 54 starts to abut against the second lock hook 2. Secondly, the controller 400 sends a vibrating control signal to the motor 51, and after receiving the vibrating control signal, firstly the output shaft of the motor 51 rotates along the second direction with the first preset angle. The output shaft of the motor 51 rotates and drives the turbine 53 to rotate clockwise, and the driving cylinder 54 abuts against the second lock hook 2 during the rotation of the driving cylinder 54 and moves toward the second lock hook 2, thereby driving the second lock hook 2 to rotate clockwise about the axis of the second pivoting shaft 21. When the rotation angle of the output shaft of the motor 51 reaches the first preset angle, the rotation angle of the second lock hook 2 reaches the first angle. Secondly, the output shaft of the motor 51 rotates with a first preset angle along the first direction, and the output shaft of the motor 51 rotates and drives the turbine 53 to drive the driving cylinder 54 to rotate counterclockwise. During the rotation of the driving cylinder 54, the driving cylinder 54 moves away from the second lock hook 2, the driving force of the driving cylinder 54 to the second lock hook 2 disappears, and the second lock hook 2 rotates counterclockwise around the axis of the second pivoting shaft 21 under the elastic force of the second elastic member 23. When the rotation angle of the output shaft of the motor 51 reaches the first preset angle, the rotation angle of the second lock hook 2 reaches the first angle. The controller 400 sends the vibrating control signal to the motor 51 with a preset number of times, so that the second lock hook 2 rotates back and forth with the first angle as a rotation angle for a preset number of times. Finally, the controller 400 sends a second control signal to the motor 51, after receiving the second control signal, the output shaft of the motor 51 rotates along the first direction with the second preset angle, and the output shaft of the motor 51 rotates and drives the turbine 53 to drive the driving cylinder 54 to rotate counterclockwise. When rotation angle of the output shaft of the motor 51 reaches the second preset angle, the driving cylinder 54 returns to the initial position.

Figure 5B:
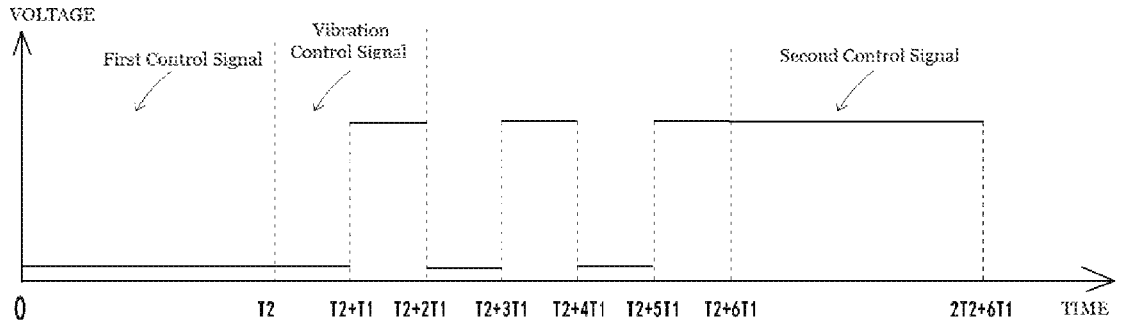
FIG. 5B is a schematic diagram of another control signal received by the motor when the second lock hook vibrates according to an embodiment of the present disclosure.

FIG. 5B is a schematic diagram illustrating another control signal received by the motor when the second lock hook vibrates according to an embodiment of the present disclosure. The control signal includes a first control signal, a vibrating control signal, and a second control signal. Similarly, when the control signal received by the motor 51 is a high level, the output shaft of the motor 51 rotates along the first direction. When the control signal received by the motor 51 is a low level, the output shaft of the motor 51 rotates along the second direction. As illustrated in FIG. 5B, the motor 51 receives the first control signal, which is a low level of duration T2, and after receiving the first control signal, the output shaft of the motor 51 rotates along the second direction. During the process, the turbine 53 drives the driving cylinder 54 to rotate clockwise from the initial position until the driving cylinder 54 starts to abut against the second lock hook 2. Then, the motor 51 receives the vibrating control signal includes the following steps. Firstly, the motor 51 receives a low level for the duration T1, the output shaft of the motor 51 rotates along the second direction with a first preset angle. During the process, the driving cylinder 54 drives the second lock hook 2 to rotate clockwise about the axis of the second pivoting shaft 21 with the first angle. Secondly, the motor 51 receives a high level for duration T1, and the output shaft of the motor 51 rotates along the first direction with the first preset angle. During the process, the second lock hook 2 rotates counterclockwise about the axis of the second pivoting shaft 21 with the first angle under the elastic force of the second elastic member 23. The motor 51 receives the three-cycle vibrating control signal. Therefore, the motor 51 drives the second lock hook 2 to rotate back and forth three times with the first angle. Finally, the motor 51 receives the second control signal, which is a high level that continues for duration T2. After receiving the second control signal, the output shaft of the motor 51 rotates along the first direction with the second preset angle. During the process, the turbine 53 drives the driving cylinder 54 to rotate counterclockwise until the driving cylinder 54 returns to the initial position.

It should be noted that, in the embodiment, when the driving assembly 5 stops working, the driving cylinder 54 is always located in the initial position. The implementation method may be: when the locker is powered on, the controller 400 controls the driving assembly 5 to move the driving cylinder 54 to the initial position. Each time the unlocking command is received and the unlocking operation is performed, the controller 400 outputs an unlocking control signal to the motor 51. After the motor 51 receiving the unlocking control signal, the driving turbine 53 drives the driving cylinder 54 to rotate 360 degrees and then stops rotating, so that the driving cylinder 54 drives the second lock hook 2 to the second lock hook unlocking position and after being separated from the second lock hook 2, the second lock hook 2 rotates back to the initial position.

In the electronic lock of other embodiments provided by the present disclosure, the driving assembly 5 includes an electromagnet. The vibrating control signal is a control signal for controlling the electromagnet to be energized for the first preset time and be power-off for the second preset time. During the process the electromagnet is energized and power-off, the second lock hook 2 rotates back and forth with a rotation angle of a first angle, thereby realizing the vibration of the second lock hook 2. The implementation process may include the followings. After receiving the vibrating control signal, the electromagnet is energized for the first preset time, and during the process the electromagnet is energized the driving shaft of the electromagnet drives the second lock hook 2 to rotate counterclockwise about the axis of the second pivoting shaft 21 with the first angle, and then power-off for a second preset time. During the process the electromagnet is power-off, the second lock hook 2 rotates clockwise around the axis of the second pivoting shaft 21 with the first angle under the elastic force of the second elastic member 23. The controller 400 sends the vibrating control signal to the electromagnet the preset number of times, so that the second lock hook 2 rotates back and forth with a rotation angle of the first angle for the preset number of times.

The above implementation process may also include the followings. After receiving the vibrating control signal, the electromagnet is energized for the first preset time. During the process the electromagnet is energized, firstly, the driving shaft of the electromagnet drives the second lock hook 2 to rotate clockwise around the axis of the second pivoting shaft 21 with the first angle. Secondly, the electromagnet is power-off for the first preset time. During the time the electromagnet is power-off, the second lock hook 2 rotates counterclockwise around the axis of the second pivoting shaft 21 with the first angle under the elastic force of the second elastic member 23. The controller 400 sends the vibrating control signal to the electromagnet the preset number of times, so that the second lock hook 2 rotates back and forth with rotation angle of the first angle for a preset number of times.

The electronic lock 300 is in the locked state or the pseudo lock state after the locking operation is performed, when the electronic lock is in the locked state, the second lock hook 2 is located in the second lock hook locking position, and when the electronic lock is in the pseudo lock state, the second lock hook 2 is located adjacent to the second lock hook locking position. When the locking operation is detected and the second lock hook is controlled to vibrate, the second lock hook 2 starts from the second lock hook locking position or adjacent to the second lock hook locking position, and rotates back and forth for a preset number of times and with the rotation angle of the first angle. The first angle is smaller than the second angle, and the second angle is a rotation angle at which the second lock hook 2 rotates from the second lock hook locking position to the second lock hook unlocking position. Therefore, when the electronic lock 300 is in the locked state, the second lock hook 2 cannot reach the second lock hook unlocking position when it rotates for the first angle. That is, the snap-fit engagement of the second lock hook 2 and the first lock hook 1 cannot be changed when the second hook 2 rotates back and forth with the rotation angle of the first angle for the preset number of times. When the electronic lock 300 is in the pseudo lock state, it is easy to change the pseudo lock state due to other external forces. Therefore, when the electronic lock 300 is in the pseudo state, when the second lock hook 2 rotates back and forth with the rotation angle of the first angle for the preset number of times, the second lock hook 2 locks the first lock hook 1 in the first lock hook locking position or the second lock hook 2 is separated from the first lock hook 1.

In the electronic lock of other embodiments provided by the present disclosure, a first lock hook driving assembly is further disposed inside the electronic lock, and the first lock hook driving assembly is configured to drive the first lock hook to rotate. A process that controlling the first lock hook to vibrate via the first lock hook driving assembly includes the followings: The controller sends a vibrating control signal to the first lock hook driving assembly to control the first lock hook driving assembly to drive the first lock hook to rotate back and forth with the first vibration angle for a first vibration preset number of times, thereby changing the pseudo lock state, so that the second lock hook locks the first lock hook in the first lock hook locking position or the second lock hook is separated from the first lock hook. The first vibration angle is smaller than an unlocking angle, and the unlocking angle is a rotation angle at which the first lock hook rotates from the first lock hook locking position to the first lock hook unlocking position, and the first vibration preset number is greater than one time.

In the electronic lock of the other embodiments provided by the present disclosure, as shown in FIG. 4, a vibrator 7 is disposed inside the lock body of the electronic lock. When the locking operation is detected, at least one of the first lock hook and the second lock hook is controlled to vibrate, and the operation includes the following: controlling the vibrator 7 to vibrate to enable at least one of the first lock hook and the second lock hook to vibrate. FIG. 4 exemplarily shows a condition that the vibrator controls the second lock hook to vibrate.

In one or more embodiments, when the locking operation is detected, the vibrator of the electronic lock vibrates with a preset amplitude by a vibrating control signal sent to the vibrator. When the vibrator vibrates, the vibrator drives the second lock hook to vibrate with a first amplitude, or drives the first lock hook to vibrate with a second amplitude. The first amplitude satisfies the condition that when the electronic lock is fully locked, the snap-fit engagement of the second lock hook and the first lock hook cannot be changed when the second lock hook vibrates with the first amplitude. When the electronic lock is in the pseudo lock state, the second lock hook is separated from the first lock hook or the second lock hook locks the first lock hook in the first lock hook locking position when the second lock hook vibrates with the first amplitude. The second amplitude satisfies the condition that when the electronic lock is fully locked, the snap-fit engagement of the second lock hook and the first lock hook cannot be changed when the first lock hook vibrates with the second amplitude. When the electronic lock is in the pseudo lock state, the second lock hook is separated from the first lock hook or the second lock hook locks the first lock hook in the first lock hook locking position when the first lock hook vibrates with the second amplitude.

In the method for controlling an electronic lock according to this embodiment, at least one of the first lock hook and the second lock hook is controlled to vibrate when the locking operation is detected. Because of the pseudo lock state is easily changed due to other external forces, therefore, via the method for controlling an electronic lock according to this embodiment, the pseudo lock state of the electronic lock can be changed by controlling at least one of the first lock hook and the second lock hook to vibrate. The second lock hook locks the first lock hook in the first lock hook locking position or the second lock hook is separated from the first lock hook, so that the electronic lock is in the locked state or the unlocked state. When the electronic lock is in the locked state, the door of the locker in which the electronic lock is installed is locked. When the electronic lock is in the unlocked state, the door of the locker in which the electronic lock is installed is opened, and the user can observe that the door has been opened and re-perform the locking operation, so that the door is locked. Therefore, the method for controlling an electronic lock according to this embodiment can improve the safety of the stored items of the user, and effectively solve the problem that the electronic lock of the related art has poor safety performance.

Figure 9:
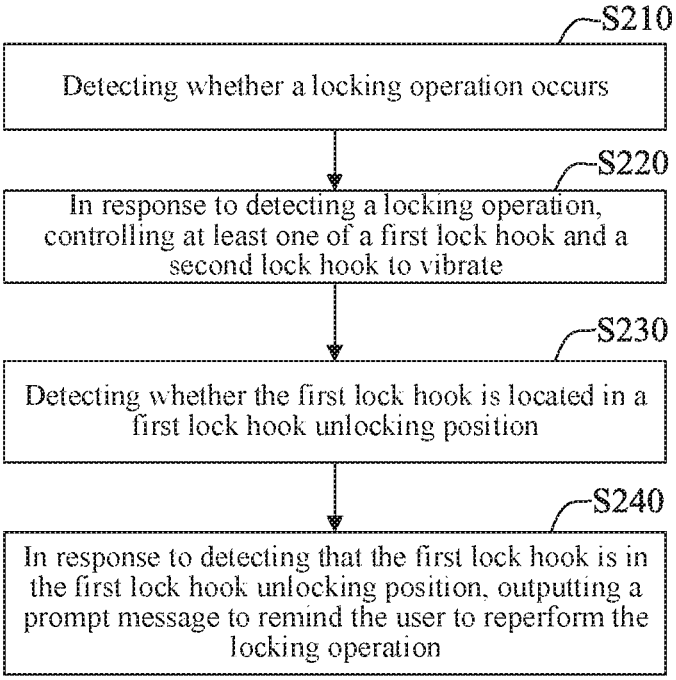
FIG. 9 is a flowchart of a method for controlling an electronic lock according to another embodiment of the present disclosure.

FIG. 9 is a flowchart of a method for controlling an electronic lock according to another embodiment of the present disclosure. The embodiment shown in FIG. 9 can be used as an alternative implementation of the embodiment shown in FIG. 8. As shown in FIG. 9, comparing with the embodiment shown in FIG. 8, after performing the step S210 and step S220, the embodiment further includes step S230 and step S240.

In step S230, the method includes detecting whether the first lock hook is located in the first lock hook unlocking position.

In this step, a detection is carried out as to whether the first lock hook is located in the first lock hook unlocking position. When the first lock hook is located in the first lock hook unlocking position, the electronic lock is determined to be in the unlocked state. Whether the first lock hook is located in the first lock hook unlocking position is detected via the detecting signal output by the sensor. Taking the locker of the embodiment as an example, after the step of controlling at least one of the first lock hook and the second lock hook to vibrate, the controller 400 detects the detecting signal output by the sensor 6 of the electronic lock 300, and determines whether the first lock hook 1 is located in the first lock hook unlocking position based on the detecting signal output by the sensor 6. For example, when detecting that the detecting signal output by the sensor 6 is the first detecting signal, the first lock hook 1 of the electronic lock 300 is determined to be located in the first lock hook unlocking position. That is, after controlling at least one of the first lock hook and the second lock hook to vibrate in step S220, the electronic lock 300 is unlocked.

In step S240, the method includes outputting a prompt message to remind a user to re-perform the locking operation, when detecting that the first lock hook is located in the first lock hook unlocking position.

When detecting that the first lock hook is located in the first lock hook unlocking position, the controller 400 controls the indication device 700 to output a prompt message to remind the user to re-perform the locking operation, thereby reminding the user to reclose the door. The indication device 700 may output the prompt message to remind the user to re-perform the locking operation in the form of light, sound, or the like, as is required by the controller 400. For example, the indication device 700 sends a prompt message to the user by flashing light at a set frequency, or the indication device 700 sends a prompt message to the user by displaying a corresponding text message, or the indication device 700 sends a prompt message to the user by buzzing at a set frequency, or the indication device 700 sends a prompt message to the user by issuing a corresponding voice message.

In the method for controlling an electronic lock according to this embodiment, after the step that at least one of the first lock hook and the second lock hook is controlled to vibrate, a detection is carried out as to whether the electronic lock is unlocked. When it is detected that the electronic lock is unlocked, a prompt message is output to remind the user to re-closed the door to avoid potential safety hazards caused by users not being able to detect door being opened in time. Therefore, the controlling method for electronic lock of the present embodiment can further solve the problem that the electronic lock of the related art has poor safety performance.

Figure 10:
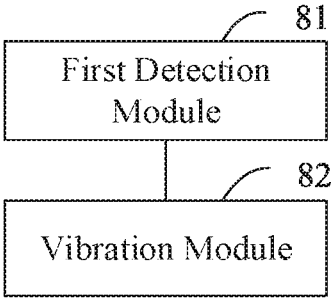
FIG. 10 is a block diagram illustrating the composition of a device for controlling an electronic lock according to an embodiment of the present disclosure.

Corresponding to the method for controlling an electronic lock illustrated in FIGS. 8 and 9, the embodiment further provides a control device for electronic lock. The control device for electronic lock may be integrated in the controller 400 of FIG. 7A for performing the method for controlling an electronic lock illustrated in FIGS. 8 and 9. FIG. 10 is a block diagram illustrating the composition of a control device for electronic lock according to an embodiment of the present disclosure. As illustrated in FIG. 10, the control device for electronic lock in this embodiment includes the following:

A first detection module 81 configured to detect whether a locking operation occurs, and the locking operation refers to an operation in which the first lock hook is moved away from the first lock hook unlocking position.

A vibration module 82 configured to control at least one of the first lock hook and the second lock hook to vibrate when the first detection module 81 detects that the locking operation has occurred, so that the second lock hook locks the first lock hook at the first lock hook locking position or the second lock hook is separated from the first lock hook.

In one or more embodiments, the vibration module 82 includes a second lock hook vibration unit configured to control the second lock hook to vibrate. The second lock hook vibration unit includes a vibration subunit configured to drive the second lock hook to rotate back and forth for a preset number of times with a rotation angle of a first angle. The preset number of times is greater than or equal to one time, and the first angle is smaller than the second angle. The second angle is a rotation angle at which the second lock hook rotates from the second lock hook locking position to the second lock hook unlocking position.

Figure 7B:
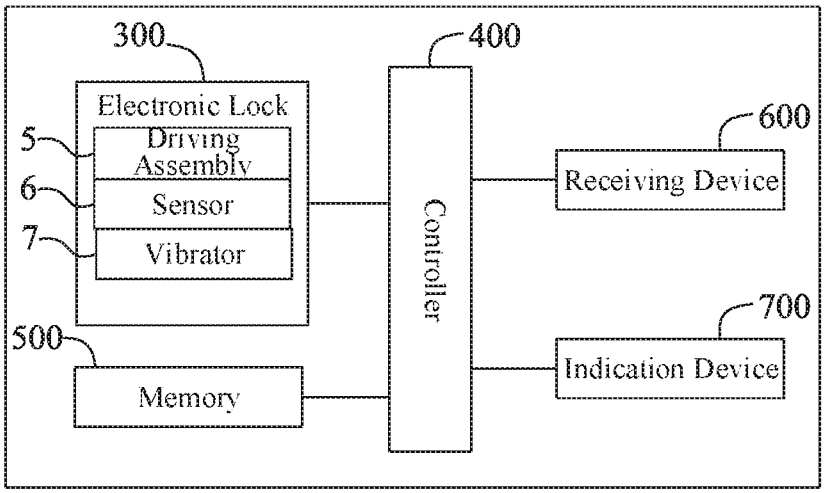
FIG. 7B is a block diagram illustrating the composition of a locker according to another embodiment of the present disclosure.

In one or more embodiments, as illustrated in FIG. 7B, the inside of the lock body of the electronic lock is further provided with a vibrator 7, vibrator 7 drives at least one of the first lock hook and the second lock hook to vibrate when the vibrator 7 vibrates. The vibration module 82 is realized by a vibrator vibration unit which is configured to control the vibrator to vibrate, so that drives at least one of the first lock hook and the second lock hook to vibrate.

In the control device for electronic lock of the embodiment, when the locking operation is detected at least one of the first lock hook and the second lock hook is controlled to vibrate. The pseudo lock state is easily changed due to other external forces when the electronic lock is in the locked state. The control device for electronic lock of the embodiment controls at least one of the first lock hook and the second lock hook to change the pseudo lock state of the electronic lock. The second lock hook locks the first lock hook in the first lock hook locking position or the second lock hook is separated from the first lock hook, so that the electronic lock is in the locked state or the unlocked state. When the electronic lock is in the locked state, the door of the locker in which the electronic lock is installed is locked. When the electronic lock is in the unlocked state, the door of the locker in which the electronic lock is installed is opened, and the user can observe that the door has been opened and re-perform the locking operation, so that the door is locked. Therefore, the control device for electronic lock according to this embodiment can improve the safety of the stored items of the user, effectively solving the problem that the electronic lock of the related art has poor safety performance.

Figure 11:
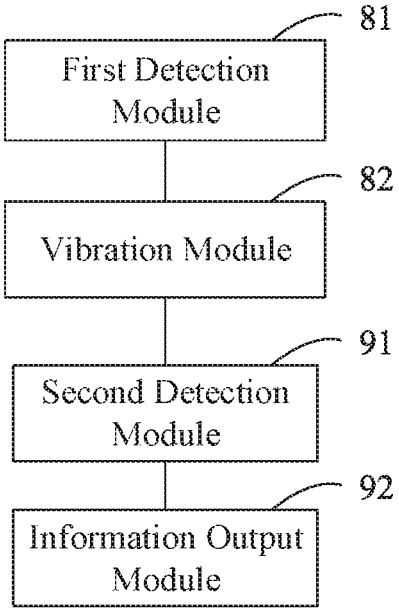
FIG. 11 is a block diagram illustrating the composition of control device for electronic lock according to another embodiment of the present disclosure.

FIG. 11 is a block diagram illustrating the composition of control device for electronic lock according to another embodiment of the present disclosure. The illustrated shown in FIG. 11 can be used as an alternative implement of the embodiment illustrated in FIG. 10. As illustrated in FIG. 11, in comparison with the embodiment illustrated in FIG. 10, the control device further includes the following modules:

A second detection module 91 configured to detect whether the first lock hook is located in the first lock hook unlocking position after the vibration module 82 controls at least one of the first lock hook and the second lock hook to vibrate.

An information output module 92 configured to output a prompt message to prompt the user to re-perform the locking operation when the second detection module 91 detects that the first lock hook is located in the first lock hook unlocking position.

In the control device for electronic lock of the embodiment, after the step of at least one of the first lock hook and the second lock hook is controlled to vibrate, a detection is carried out as to whether the electronic lock is unlocked. When detecting the electronic lock is unlocked, a prompt message is output to remind the user to re-close the door to avoid potential safety hazards caused by users not being able to detect door being opened in time. Therefore, the control device for electronic lock of the present embodiment can further solve the problem that the electronic lock of the related art has poor safety performance.

The control device for electronic lock provided by the embodiment of the present disclosure may be specific hardware on the device or software or firmware installed on the device and the like. The implementation principle and the technical effects of the device provided in this embodiment are the same as those in the foregoing method embodiments. For the sake of brevity, reference may be made to the corresponding content in the foregoing method embodiments where it is not mentioned in the device embodiments. Those skilled in the art may clearly understand that for convenience and brevity of description, the working processes of the system, the device and the unit described above may refer to the corresponding processes in the foregoing method embodiments, and so details are not to be described herein again.

In the embodiments provided by the present disclosure, it should be understood that the device and method may be implemented in other manners. The device embodiments described above are merely illustrative. For example, the division of the unit is only a logical function division. In actual implementation, other division manners would also be possible. For example, multiple units or components may be combined or may be integrated into another system, or some features may be ignored or not executed. In addition, the mutual coupling or direct coupling or communication connection shown or discussed may be an indirect coupling or communication connection through some communication interface, device or unit, and may be in an electrical, mechanical or other form.

The units described as separate components may or may not be physically separated, and the components displayed as units may or may not be physical units, namely they may be located in one place, or may be distributed as multiple network units. Some or all of the units may be selected according to actual needs to achieve the objectives of the embodiments of the present disclosure.

In addition, each functional unit in the embodiment provided by the present disclosure may be integrated into one processing unit, or each unit may exist physically separate, or two or more units may be integrated into one.

An embodiment of the present disclosure further provides a computer readable storage medium storing computer executable instructions configured to perform the method for controlling an electronic lock in accordance with any of the above embodiments.

The functions may be stored in a computer readable storage medium if implemented in the form of a software functional unit and sold or used as a standalone product. Based on such an understanding, a portion of the technical solution of the present disclosure that contributes in essence or to the prior art or a portion of the technical solution may be embodied in the form of a software product stored in a storage medium, including the instructions configured to cause a computer device (which may be a personal computer, server, or network device, and the like) to perform all or part of the steps of the methods described in various embodiments of the present disclosure. The foregoing storage medium includes: a USB flash disk, a mobile hard disk, a read-only memory (ROM), a random access memory (RAM), a magnetic disk, or an optical disk, and the like, which can store program code.

It should be noted that similar reference numerals and letters indicate similar items in the accompanying drawings. Therefore, once an item is defined in a drawing, it is unnecessary to further define and explain it in the subsequent drawings. Moreover, the terms "first", "second", "third", and the like are used merely to distinguish from one another, and are not to be construed as indicating or implying a relative importance.

INDUSTRIAL APPLICABILITY

The present disclosure can improve the security of the user's stored items, and effectively solve the problem that the electronic lock in the related art has unsatisfactory security performance.

The invention claimed is:

1. A method for controlling an electronic lock, wherein the electronic lock comprises a lock catch and a lock body, the lock body comprises a first lock hook and a second lock hook;

the first lock hook has a first lock hook locking position where the first lock hook is engaged with the lock catch and a first lock hook unlocking position where the first lock hook is separated from the lock catch; the second lock hook has a second lock hook locking position where the second lock hook is operative to lock the first lock hook in the first lock hook locking position and a second lock hook unlocking position where the second lock hook is separated from the first lock hook;

wherein the method comprises:

detecting, by a controller, whether a locking operation has occurred by the electronic lock, where the locking operation is an operation in which the first lock hook moves from the first lock hook unlocking position; and controlling, by the controller, at least one of the first lock hook and the second lock hook to vibrate when the locking operation is detected, to enable the second lock hook to lock the first lock hook in the first lock hook locking position or to be separate from the first lock hook.

2. The method according to claim 1, wherein controlling at least one of the first lock hook and the second lock hook to vibrate comprises:

controlling the second lock hook to vibrate.

3. The method according to claim 2, wherein the lock body comprises a housing, the second lock hook is pivotally connected to the housing via a pivoting shaft, and the second lock hook is operative to rotate about the pivoting shaft to the second lock hook locking position or the second lock hook unlocking position, wherein controlling the second lock hook to vibrate comprises:

driving the second lock hook to rotate back and forth a preset number of times with a rotation angle of a first angle; wherein the preset number of times is greater than or equal to one time, wherein the first angle is smaller than a second angle, and the second angle is a rotation angle at which the second lock hook rotates from the second lock hook locking position to the second lock hook unlocking position.

4. The method according to claim 1, wherein the electronic lock further comprises a vibrator disposed within the lock body and when the vibrator vibrates, the vibrator is operative to drive at least one of the first lock hook and the second lock hook to vibrate; wherein controlling at least one of the first lock hook and the second lock hook to vibrate comprises:

controlling the vibrator to vibrate to drive at least one of the first lock hook and the second lock hook to vibrate.

5. The method according to claim 1, further comprising the following operations subsequent to controlling at least one of the first lock hook and the second lock hook to vibrate:

detecting, by the controller, whether the first lock hook is located in the first lock hook unlocking position; and in response to detecting that the first lock hook is located in the first lock hook unlocking position, outputting, by an indication device, a prompt message to remind a user to re-perform the locking operation.

6. The method according to claim 2, further comprising the following operations subsequent to controlling at least one of the first lock hook and the second lock hook to vibrate:

detecting, by the controller, whether the first lock hook is located in the first lock hook unlocking position; and in response to detecting that the first lock hook is located in the first lock hook unlocking position, outputting, by an indication device, a prompt message to remind a user to re-perform the locking operation.

7. The method according to claim 3, further comprising the following operations subsequent to controlling at least one of the first lock hook and the second lock hook to vibrate:

detecting, by the controller, whether the first lock hook is located in the first lock hook unlocking position; and in response to detecting that the first lock hook is located in the first lock hook unlocking position, outputting, by an indication device, a prompt message to remind a user to re-perform the locking operation.

8. The method according to claim 4, further comprising the following operations subsequent to controlling at least one of the first lock hook and the second lock hook to vibrate:

detecting, by the controller, whether the first lock hook is located in the first lock hook unlocking position; and in response to detecting that the first lock hook is located in the first lock hook unlocking position, outputting, by an indication device, a prompt message to remind a user to re-perform the locking operation.

* * * * *